United States Patent [19]

Cunningham

[11] 3,989,407

[45] Nov. 2, 1976

[54] WHEEL CONTAINMENT APPARATUS AND METHOD

[75] Inventor: Thomas H. M. Cunningham, Phoenix, Ariz.

[73] Assignee: The Garrett Corporation, Los Angeles, Calif.

[22] Filed: Apr. 30, 1975

[21] Appl. No.: 573,271

[52] U.S. Cl. ..... 415/1; 60/39.09 R; 192/129 R; 415/9; 415/123; 416/2; 416/169 R

[51] Int. Cl.[2] ..... F01D 21/04

[58] Field of Search ..... 415/9, 34, 1, 123, 178; 60/39.09; 192/129 R; 416/2, 169

[56] References Cited

UNITED STATES PATENTS

| | | | |
|---|---|---|---|
| 1,469,045 | 9/1923 | MacMurchy | 415/9 |
| 2,569,898 | 10/1951 | Millns | 415/123 |
| 2,966,333 | 12/1960 | Flanagan | 416/2 |
| 3,048,364 | 8/1962 | Troeger et al. | 415/9 |
| 3,075,741 | 1/1963 | Laubin | 415/9 |
| 3,097,824 | 7/1963 | Bunger et al. | 415/9 |
| 3,261,228 | 7/1966 | Rothman | 415/9 |
| 3,849,022 | 11/1974 | Amann et al. | 415/9 |

*Primary Examiner*—C. J. Husar
*Attorney, Agent, or Firm*—James W. McFarland; Albert J. Miller

[57] ABSTRACT

A cutter ring operable to sever the blades of a turbine wheel in a gas turbine engine upon failure of a thrust bearing carrying the wheel in the turbine. Severance occurs while the blades are within the confines of a containment ring to prevent fragments from being ejected out of the turbine housing. The cutter also presents a friction pad of high heat absorption characteristics for reducing maximum temperature developed in the engine upon bearing failure.

17 Claims, 4 Drawing Figures

WHEEL CONTAINMENT APPARATUS AND METHOD

BACKGROUND OF THE INVENTION

This invention relates to gas turbine machines and relates more particularly to axial flow type gas turbine machinery having a rotating turbine wheel.

Turbomachines of the type described normally include a turbine wheel that is rotatably mounted to the machine housing through an axial thrust bearing. Blades on the wheel traverse a fluid flow duct and are arranged either to be rotated by flow in the duct or to induce and compress airflow through the duct. The turbine conventionally is made of high quality and high strength material (such as a titanium alloy) to withstand the stresses of rotational speeds of several thousand r.p.m., while the housing is of a light-weight material such as aluminum. Failure of the thrust bearing may create a hazardous condition since high energy fragments thrown from the titanium wheel may pierce the relatively thin housing and be expelled from the machine at a sufficiently high energy level to cause damage to surrounding components and structure. Additional damage can occur during failure as the result of the high temperature developed by the frictional contact between the wheel and hard materials carried by the housing. Such generated heat is normally entrained in and carried from the housing in the gas exhaust from the duct, thereby possibly creating an extremely high temperature exhaust airflow.

To reduce ejection of high energy wheel fragments, a containment ring may be incorporated in surrounding relationship to the wheel, such as described in U.S. Pat. No. 3,241,813. The containment ring is sufficiently strong and massive to prevent fragment penetration. For various purposes, including weight and space economy, the containment ring is of limited axial extent. Accordingly, upon failure of the thrust bearing and consequent axial shifting of certain turbine wheel arrangements due to external loads imposed thereon and/or the mass flow in the duct, the wheel may move past the axial confines of the containment ring before fragments thereof are ejected by centrifugal force. Thus, such fragments may not be retained in the housing by the containment ring. Further, due to the general unpredictability of events during such a failure, many such wheel fragments may be expelled.

It is a broad object of the present invention to provide in a gas turbine machine wherein the turbine wheel is subject to axial shifting to locations outside the confines of a containment ring upon occurrence of certain failures of the machine, apparatus and method for containing fragments of the wheel thrown centrifugally therefrom upon failure.

Another important object of the invention is to provide apparatus for absorbing heat generated upon failure of a gas turbine machine.

A more particular object is to provide apparatus in accordance with the preceding object which includes a pad of high heat absorption, low melting point material which frictionally engages a rotating turbine wheel of the machine upon failure in order to reduce temperature generated in the machine, and more particularly to reduce the maximum temperature developed in the flow of working fluid exhausting from the machine upon failure.

Yet another object of the invention is to provide severing means in a gas turbine machine which engage and sever the peripheral blades of a turbine wheel upon axial shifting of the latter as a result of failure of a thrust bearing rotatably mounting the turbine wheel within the machine housing. The severing means are located and arranged to sever the peripheral blades while the latter are within the confines of a containment ring normally radially surrounding the turbine wheel.

More particularly, the severing means includes a plurality of circularly arranged cutter pins that engage the wheel to sever the blades, the pins being embedded in, but extending a short axial distance from, a pad of high heat absorption material that presents a relatively large area of frictional contact with the wheel upon failure.

These and other objects and advantages of the present invention are specifically set forth in or will become apparent from the following detailed description of a preferred embodiment of the invention when read in conjunction with the accompanying drawings, wherein:

DESCRIPTION OF THE PREFERRED EMBODIMENTS

Figure 2:
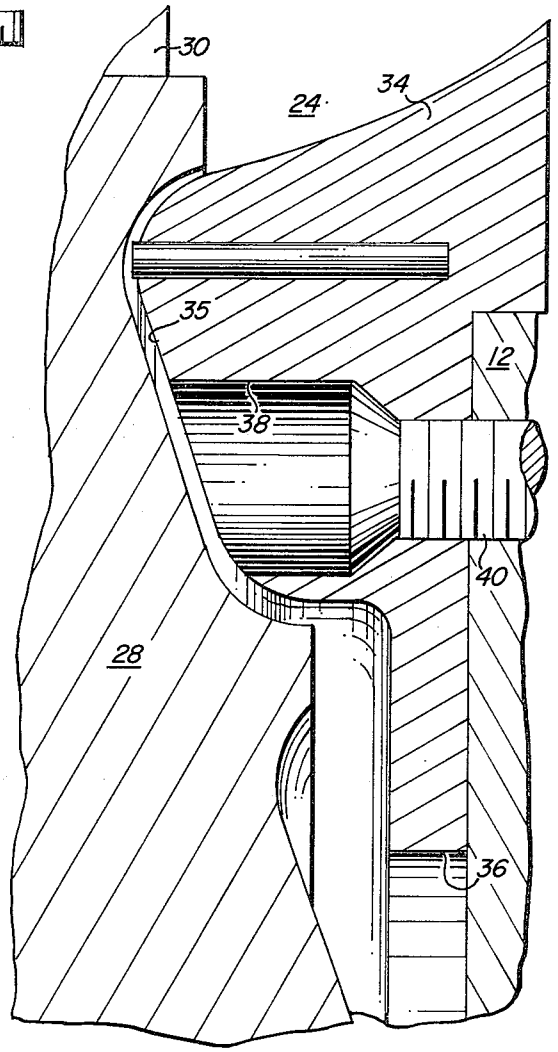
FIG. 2 is an enlarged view of the area of FIG. 1 circumscribed by dashed line 2.
Figure 1:
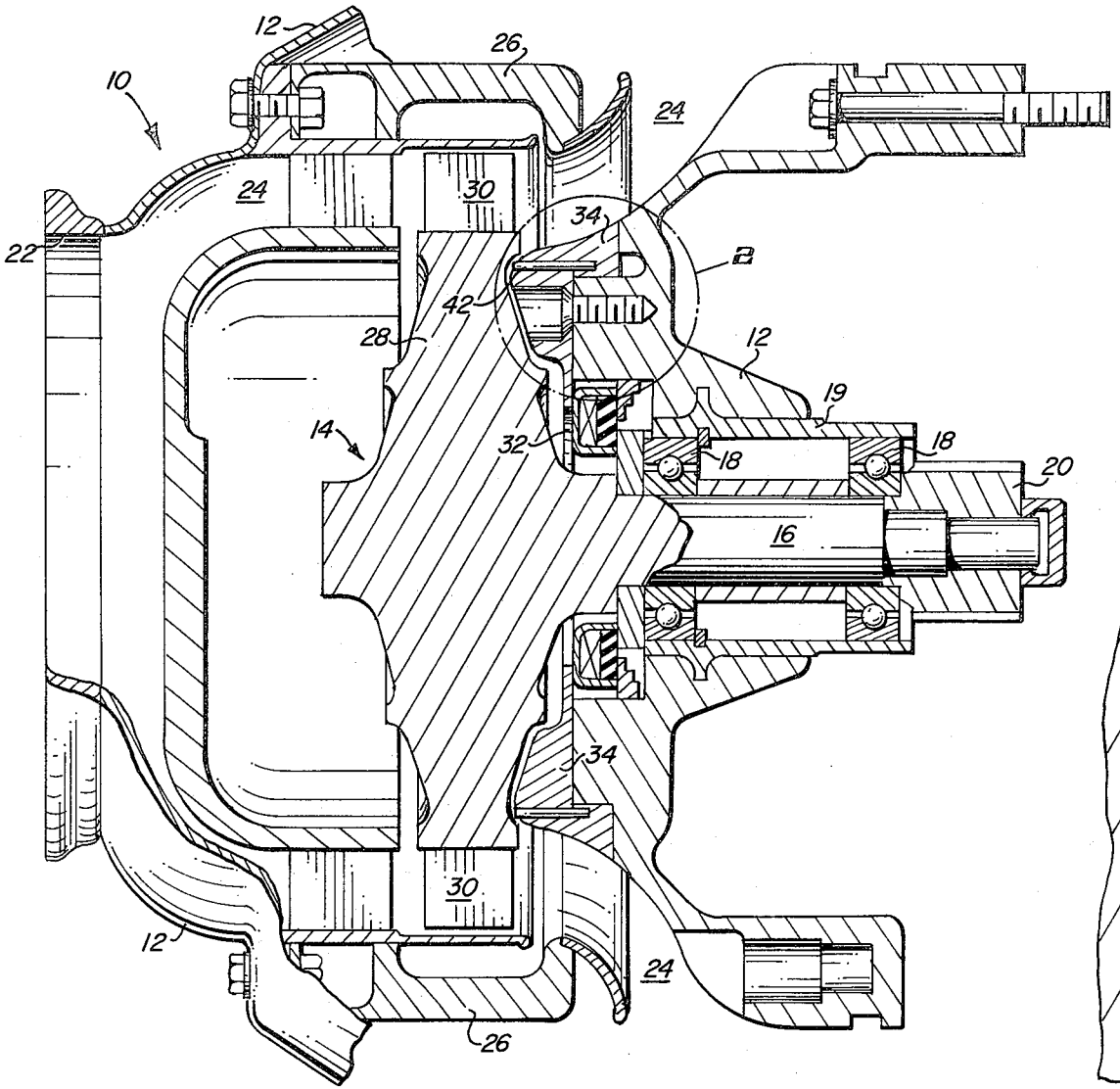
FIG. 1 is a partial longitudinal cross-sectional view of a gas turbine engine incorporating the present invention.
Figure 3:
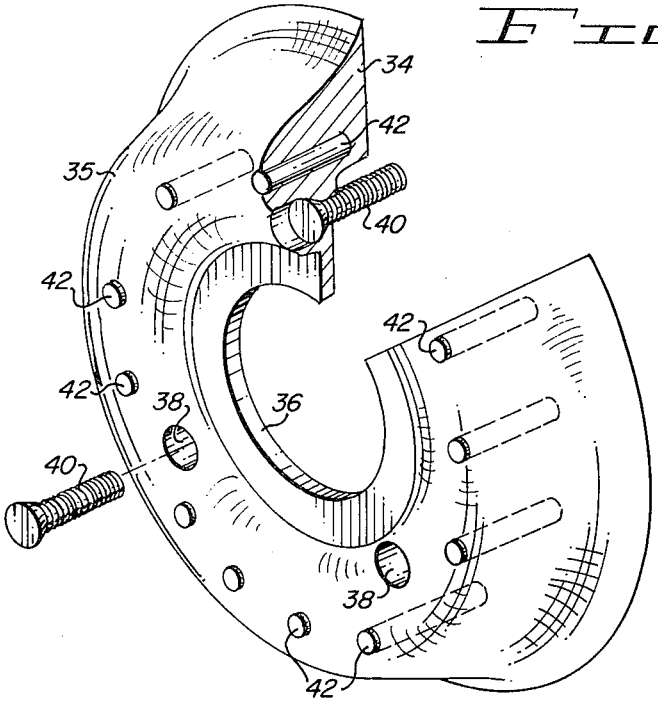
FIG. 3 is a front perspective view of the pad assembly contemplated by the present invention, with portions broken away to reveal details of construction.
Figure 4:
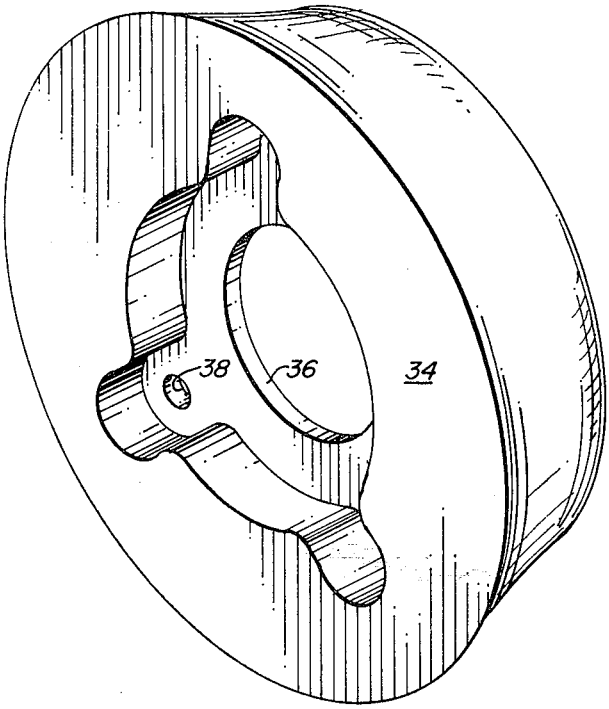
FIG. 4 is a rear perspective view similar to FIG. 3.

Referring now more particularly to the drawings, FIG. 1 depicts one end of a high speed gas turbine machine 10 such as a gas turbine starter providing power to start a large aircraft turbine engine, or an auxiliary power unit operating the auxiliary systems of an aircraft. The turbine engine includes a relatively thin aluminum casing or housing 12, and turbine wheel 14 formed or mounted to an axially extending shaft 16 suitably journaled to the housing for high speed rotation by an axial thrust roller bearing or bearings 18. Housing 12 includes relatively hard, high melting point inserts, such as cylindrical bearing carrier insert 19 formed of high grade, high melting point steel material. A gear 20 on shaft 16 provides power to a gear train and auxiliary power systems not shown.

Housing 12 defines a gas or air inlet 22 at its leftward end, and an annular gas duct 24 that extends through the housing past wheel 14 to flare radially outwardly and terminate in a radially directed, annular exhaust opening (not shown) in the housing. An appropriate seal pack 32 seals the central opening in the housing receiving shaft 16.

Mounted to the housing is a relatively thick, strong, circular containment ring 26 arranged in generally axially aligned, peripherally surrounding relationship to wheel 14. As described in detail in the aforementioned U.S. Pat. No. 3,241,813, to which reference may be made for more particulars although not necessary to an understanding of the present invention, containment ring 26 is enshrouded by housing 12 and acts to contain and prevent penetration of the housing by high energy particles or fragments (particularly fragments of wheel 14) created upon failure of the machine and thrown against ring 26 by high centrifugal forces. Ring 26 is particularly suitable to contain fragments generated within its axial confines, i.e., a central zone within ring 26 of axial length substantially equal to the preselected axial length of ring 26. It will be apparent that weight, cost and space considerations limit the practical axial extent of ring 26.

Turbine wheel 14 is preferably constructed of high strength material such as a titanium alloy having a very high flash or melting point in the neighborhood of about 2,000° F. Wheel 14 includes a central hub portion 28 and a plurality of peripheral, radially extending blades 30 that are disposed within and extend substantially across duct 24. The narrowest axial thickness of hub 28 occurs closely adjacent to and slightly radially inwardly from blades 30.

The turbomachine further includes an annular pad 34 disposed generally between wheel 14 and bearing 16 and having a forward face 35 spaced axially closely adjacent to one side of wheel 14, this forward face 35 being of a configuration substantially mating with the irregular side face of wheel 14. A relatively large central aperture 36 in pad 34 receives shaft 16, and the pad also has three or more countersunk holes 38 receiving threaded bolts 40 that securely mount pad 34 in stationary relationship to housing 12, the heads of bolts 40 being recessed a substantial axial distance from the forward face 35 of the pad. Pad 34 is preferably constructed of material such as brass, aluminum, or ablative plastics having a relatively low melting point and relatively high heat absorption characteristics in comparison to inserts in the housing such as bearing carrier 19.

Embedded within pad 34 are a plurality of axially extending pins 42 of relatively hard material such as tungsten carbide. The twelve pins 42 illustrated are arranged in a circular pattern about pad 34 in alignment preferably with the narrowest point in hub 28, i.e., slightly radially inwardly of blades 30. Pins 42 protrude slightly from face 35 toward wheel 14.

In operation, gas fed from inlet 22 through duct 24 impinges upon blades 30 to rotate wheel 14 at high speeds upon bearing 18. In the event of failure of thrust bearing 18 due to axial loads imposed upon shaft 16 and/or the mass flow in duct 24, or certain other failures of the machine, wheel 14 tends to shift toward bearing 18, or rightwardly as viewed in FIG. 1. The first destructive contact of wheel 14 is with the pins 42 which cut through the narrowest part of the hub to sever blades 30 therefrom. The location of pins 42 substantially assures that blades 30 are severed while still within the axial confines of containment ring 26. Consequently, fragments of wheel 14 (and blades 30 as they are severed) are thrown outwardly to impinge upon ring 26 and be contained thereby within housing 12.

As wheel 14 comes into frictional contact with the relatively large surface of pad 34 presented by face 35, a substantial proportion of heat generated within the machine is absorbed by the rub pad 34. As pad 34 tends to melt and molten products thereof are carried away by the exhausting gas, the temperature of the pad does not exceed its relatively low melting point. The temperature reached by the mass flow working fluid exhausting from duct 24 thereby also is maintained at a relatively low level, substantially reduced from the maximum temperature that may be attained by the mass flow during failure in the absence of rub pad 34. Heat generated is thus carried away from the points of destructive contact of the wheel during its deceleration upon bearing failure, both by conduction into the good thermally conductive material of the pad and by the expulsion of molten pad material.

By way of comparison, it is believed that failure occurrence in prior art devices allows the turbine wheel to shift axially until a hard segment of the housing such as bearing carrier 19 is contacted, whereupon cutting commences. Temperature generated during such cutting approaches the melting point of the titanium wheel, and no substantial heat absorbing material is present at the cutting point. It is believed that segments of the wheel may reach vaporization in the forced air stream of duct 24, allowing the temperatures in the air stream and outside the machine to approach the extremely high temperature of vaporizing titanium. The present invention obviates such difficulties by providing a controlled sequence of events during failure, including control of the location of blade cutting as well as absorption and control of heat generated by failure.

Particles that may be carried or ejected through the exhaust from duct 24 are of considerably lower temperature and energy in comparison to that which occurs during bearing failure of a turbine machine not incorporating pad 34 and pins 42. The higher energy particles are separated while within the axial confinement zone defined by containment ring 26 rather than after the wheel 14 has been axially displaced outside the ring confines. Tests have shown a significant reduction in overall temperature developed in the machine during failure, particularly temperature of gas flow, substantially no fragment penetration of the machine housing, and very little ejection of only low energy particles through the exhaust opening.

It will therefore be apparent that the invention provides blade severing means in the form of cutter pins 42 embedded in a heat absorbing rub pad 34. Further, the invention provides a method of gas turbine construction that includes the provision of containment ring 26, the relative arrangement of the ring such that blades 30 are within its axial confines, the mounting of wheel 14 to the housing such that it shifts axially in the event of subsequent failure of bearing 18, and the inclusion of pins 42 to assure severance of blades 30 while the latter are still inside ring 26. This method of construction thereby assures retention of fragments in the housing in the event of later bearing failure. The invention also provides an improved method of containing fragments within the housing upon bearing failure by arranging the wheel 14 and ring 26 (the latter being emplaced in the housing for containment purposes) with blades 30 inside the axial confines of the ring, allowing the wheel to shift axially upon bearing failure, and by severing blades 30 upon axial shifting but while the blades are still within containment ring 26.

Various modifications and alterations to the above will be apparent to those skilled in the art. Accordingly, the foregoing detailed description should be considered exemplary in nature and not as limiting to the scope and spirit of the invention as defined in the appended claims.

Having thus described the invention with sufficient clarity that those skilled in the art may make and use it,

What I claim is:

1. In combination:

a housing having a fluid duct for carrying fluid flow through the housing;

a turbine wheel in the housing having peripherally disposed blades interposed in said duct;

bearing means for rotatably mounting said wheel in the housing, said wheel tending to shift axially in the housing upon failure of said bearing means;

a containment ring secured to said housing in normally axially aligned, peripherally surrounding relationship to said wheel, said ring operable upon said bearing failure to contain within said housing, fragments of said wheel thrown centrifugally therefrom while said wheel is generally axially aligned with said ring; and severing means rigidly secured to said housing adjacent and axially spaced from said wheel, said severing means operable upon said axial shifting of the wheel to engage the latter and sever said blades while the blades are generally axially aligned with said ring to assure that said blades are contained within said housing upon bearing failure.

2. A combination as set forth in claim 1, wherein said containment ring is of a preselected axial length defining a generally cylindrical zone inside said ring of corresponding axial length, said blades being severed while substantially within said cylindrical zone.

3. A combination as set forth in claim 1, wherein said wheel includes a continuous central hub from which said blades extend radially outwardly, said severing means being arranged to engage said hub upon said bearing failure at a radial location closely adjacent said blades.

4. In combination:

a housing having a fluid duct for carrying fluid flow through the housing;

a turbine wheel in the housing having peripherally disposed blades interposed in said duct;

bearing means for rotatably mounting said wheel in the housing, said wheel tending to shift axially in the housing upon failure of said bearing means;

a containment ring secured to said housing in normally axially aligned, peripherally surrounding relationship to said wheel, said ring operable upon said bearing failure to contain within said housing, fragments of said wheel thrown centrifugally therefrom while said wheel is generally axially aligned with said ring; and severing means rigidly secured to said housing adjacent and axially spaced from said wheel, said severing means operable upon said axial shifting of the wheel to engage the latter and sever said blades while the blades are generally axially aligned with said ring to assure that said blades are contained within said housing upon bearing failure, said severing means including a rigid pad secured to said housing, and cutter means affixed to said pad extending axially therefrom toward said wheel.

5. A combination as set forth in claim 4, wherein said pad is of a metallic material having relatively high heat absorption characteristics.

6. A combination as set forth in claim 5, wherein said pad is of a metallic material of low melting point and high heat absorption characteristics relative to the melting point and heat absorption characteristics of at least segments of said housing, said pad arranged with a face thereof having a substantially extensive surface frictionally engagable with said wheel upon said bearing failure to reduce the increase in temperature of fluid in said duct upon bearing failure.

7. A combination as set forth in claim 4, wherein said cutter means includes a plurality of axially extending pins embedded in said pad and spaced in a circular pattern thereabout.

8. A combination as set forth in claim 7, wherein said pad is of a circular ring configuration, said machine further including a shaft extending axially through said pad, said wheel being secured to said shaft on one side of said pad.

9. A combination as set forth in claim 8, wherein said bearing means includes an axial thrust roller bearing rotatably mounting said shaft to said housing, said roller bearing being disposed on a side of said pad opposite said one side.

10. A combination as set forth in claim 9, wherein said pad is of a metallic material of low melting point and high heat absorption characteristics relative to the melting point and heat absorption characteristics of said housing, said pad arranged with a face thereof having an extensive surface frictionally engagable with said wheel upon said bearing failure, said pins extending axially from said surface toward said wheel.

11. A combination as set forth in claim 10, wherein said housing is primarily aluminum, said pad is primarily brass, said wheel is primarily titanium alloy, and said pins are primarily tungsten carbide.

12. In a fluid turbine machine having a housing and a rotatable turbine wheel provided with a central hub and blades disposed at the periphery of the hub;

bearing means for rotatably mounting said wheel to the housing, said wheel arranged whereby upon failure of said bearing means the wheel tends to shift in an axial direction;

a containment ring secured to said housing in radially surrounding relationship to said blades; and means rigidly secured to said housing in adjacent, normally axially spaced relationship to said wheel for engaging said wheel and severing said blades from said hub upon failure of said bearing means and axial shifting of the wheel, said severing means being arranged to sever said blades while the latter are within the axial confines of said containment ring to allow said ring to retain said severed blades within the housing.

13. In a turbine machine having a housing, a turbine wheel provided with peripheral blades and rotatably mounted in the housing in a manner whereby said wheel is subject to axial shifting in the event of certain failures of the machine, and a containment ring radially surrounding said blades, wherein the improvement comprises: means rigidly secured to the housing in axially spaced relationship to said wheel and arranged and configured relative to said wheel and said containment ring for engaging said wheel and severing said blades therefrom upon axial movement of the wheel and while the blades are within the axial confines of said ring.

14. In combination with a turbine machine having a turbine wheel rotatably mounted within a housing such that the wheel is subject to axial shifting in the event of certain failures of the machine:

a nonrotating rub pad secured to said housing in normally axially spaced relationship to said wheel, at least a portion of said rub pad operable upon axial movement of the wheel to frictionally engage the wheel, said portion of the pad being of a material having relatively high heat absorption characteristics for absorbing heat generated by said frictional engagement.

15. A method of constructing a turbine machine to assure retention of fragments of a turbine wheel within the housing of the machine in the event of subsequent failure of a bearing rotatably carrying said wheel in the housing, comprising the steps of:

providing a containment ring in the housing for containing metallic fragments generated therewithin in the event of subsequent bearing failure;

relatively arranging said ring and said wheel with peripheral blades of the latter disposed within axial confines of said ring;

mounting said wheel in said housing whereby said wheel tends to shift axially in the event of subsequent bearing failure; and providing means for severing said blades from the wheel upon axial shifting of the wheel but while said blades are within said axial confines of the ring, whereby said steps assure retention of the severed blades within said housing in the event of subsequent bearing failure.

16. A method of containing fragments of a turbine wheel within the housing of a turbine machine upon failure of a bearing rotatably carrying said wheel in the housing, comprising the steps of:

emplacing a containment ring in the housing for containing fragments generated therewithin upon bearing failure;

relatively arranging said ring and said wheel with peripheral blades of the latter disposed within axial confines of said ring;

permitting said wheel to shift axially upon bearing failure; and severing said blades from the wheel upon axial shifting of the wheel but while said blades are within said axial confines of the ring, whereby the severed blades are contained within the housing upon bearing failure.

17. In combination with a turbine machine having a turbine wheel rotatably mounted within a housing such that the wheel is subject to axial shifting in the event of certain failures of the machine:

a section of material having a low melting point relative to the flash point of said wheel, said section located axially adjacent said wheel; and a plurality of axially extending cutter pins embedded in said section and spaced in a circular pattern thereabout for engaging said wheel to cut the latter upon said axial shifting, said section operable to frictionally engage said wheel to absorb heat generated during cutting of the wheel.

* * * * *